US011532446B2

(12) United States Patent
Wang et al.

(10) Patent No.: US 11,532,446 B2
(45) Date of Patent: Dec. 20, 2022

(54) BUTTON STRUCTURE OF INPUT DEVICE

(71) Applicant: Acer Incorporated, New Taipei (TW)

(72) Inventors: Yu-Shih Wang, New Taipei (TW); Chih-Chun Liu, New Taipei (TW); Cheng-Nan Ling, New Taipei (TW); Wen-Chieh Tai, New Taipei (TW)

(73) Assignee: Acer Incorporated, New Taipei (TW)

( * ) Notice: Subject to any disclaimer, the term of this patent is extended or adjusted under 35 U.S.C. 154(b) by 11 days.

(21) Appl. No.: 17/329,180

(22) Filed: May 25, 2021

(65) Prior Publication Data

US 2021/0398758 A1 Dec. 23, 2021

(30) Foreign Application Priority Data

Jun. 18, 2020 (TW) ..... 109120542

(51) Int. Cl.

| | |
|---|---|
| ***H01H 13/704*** | (2006.01) |
| ***H01H 1/58*** | (2006.01) |
| ***H01H 13/14*** | (2006.01) |
| ***H01H 13/48*** | (2006.01) |

(52) U.S. Cl.

CPC ..... *H01H 13/704* (2013.01); *H01H 1/5805* (2013.01); *H01H 13/14* (2013.01); *H01H 13/48* (2013.01); *H01H 2215/006* (2013.01)

(58) Field of Classification Search

CPC .... H01H 13/704; H01H 1/5805; H01H 13/14; H01H 13/48; G06F 3/0202; G06F 3/02

USPC ..... 200/5 A, 516, 406

See application file for complete search history.

(56) References Cited

U.S. PATENT DOCUMENTS

| | | | | |
|---|---|---|---|---|
| 4,843,197 | A * | 6/1989 | Kojima | H01H 11/0056 200/406 |
| 8,835,787 | B2 * | 9/2014 | Takeuchi | H01H 13/04 200/516 |
| 10,515,771 | B2 * | 12/2019 | Yano | H01H 13/705 |
| 2008/0251369 | A1 * | 10/2008 | Villain | H01H 13/06 200/534 |
| 2018/0358193 | A1 * | 12/2018 | Chen | H01H 11/06 |
| 2019/0311865 | A1 * | 10/2019 | Ogawa | H01H 13/14 |

FOREIGN PATENT DOCUMENTS

| | | |
|---|---|---|
| CN | 1197105 | 4/2005 |
| CN | 206003671 | 3/2017 |
| TW | 201007796 | 2/2010 |
| TW | M468768 | 12/2013 |
| TW | 201417130 | 5/2014 |

* cited by examiner

*Primary Examiner* — Renee S Luebke
*Assistant Examiner* — Iman Malakooti
(74) *Attorney, Agent, or Firm* — JCIPRNET

(57) ABSTRACT

A button structure of an input device, including a circuit board, a dome element, and a trigger, is provided. The dome element is disposed on the circuit board, and is electrically conductive and elastic. The trigger is disposed at a center of the dome element, and is electrically insulative and flexible. The trigger has a conductive layer facing the circuit board. The dome element is configured to be pressed to drive the conductive layer of the trigger to abut against a trigger circuit of the circuit board to generate a trigger signal.

6 Claims, 2 Drawing Sheets

BUTTON STRUCTURE OF INPUT DEVICE

CROSS-REFERENCE TO RELATED APPLICATION

This application claims the priority benefit of Taiwan application serial no. 109120542, filed on Jun. 18, 2020. The entirety of the above-mentioned patent application is hereby incorporated by reference herein and made a part of this specification.

BACKGROUND OF THE INVENTION

1. Field of the Invention

The invention relates to a button structure, and in particular, to a key structure of an input device.

2. Description of Related Art

With the advent of the information technology era and the popularization and application of a portable electronic device such as a computer or a mobile phone, a keystroke module used for data input or electronic device manipulation is becoming increasingly more important and diversified.

A keyboard is used as an example. A keycap, an elastic member, a linkage mechanism, and a trigger circuit usually serve as main components thereof. A user presses the keycap, and then drives a trigger circuit to generate a trigger signal through a physical abutting action of the linkage mechanism and the elastic member.

However, with the requirements of the user for hand feeling and noise prevention and the development trend that the electronic device is gradually becoming thinner and lighter, the existing keyboard or a related keystroke module cannot meet the foregoing conditions at the same time, or still requires a more complicated manufacturing process or higher manufacturing costs even if meeting the foregoing requirements.

SUMMARY OF THE INVENTION

The invention provides a button structure of an input device, which has both a low pressing stroke and a mute effect.

The button structure of the input device of the invention includes a circuit board, a dome element, and a trigger. The dome element is disposed on the circuit board and is electrically conductive and elastic. The trigger includes electrical insulation and is disposed at a center of the dome element. The trigger includes a conductive layer facing the circuit board, where the dome element is configured to be pressed to drive the conductive layer of the trigger to abut against a trigger circuit of the circuit board to generate a trigger signal.

Based on the above, in the button structure of the input device, the dome element is electrically conductive and elastic, and the trigger is disposed at the center of the dome element, is electrically insulative and flexible, and has the conductive layer facing the circuit board. Accordingly, when the dome element is pressed, the trigger signal may be smoothly generated by driving the conductive layer of the trigger to abut against the trigger circuit of the circuit board, and the impact force between the components may be effectively reduced due to the flexibility of the trigger during triggering, thereby reducing noise caused by mutual impact between the components. In addition, elastic force is accumulated due to deformation caused by pressing the dome element.

On the contrary, when the dome element is not pressed, the elastic force accumulated in the dome element may drive the trigger to reset smoothly away from the circuit board. In other words, for the button structure, the trigger may be reset smoothly only by the dome element without the help of other components, so that the button structure is simplified and has a shorter pressing stroke, and a situation that the components cannot be thinned due to stacking may be avoided.

DESCRIPTION OF THE EMBODIMENTS

Figure 1:
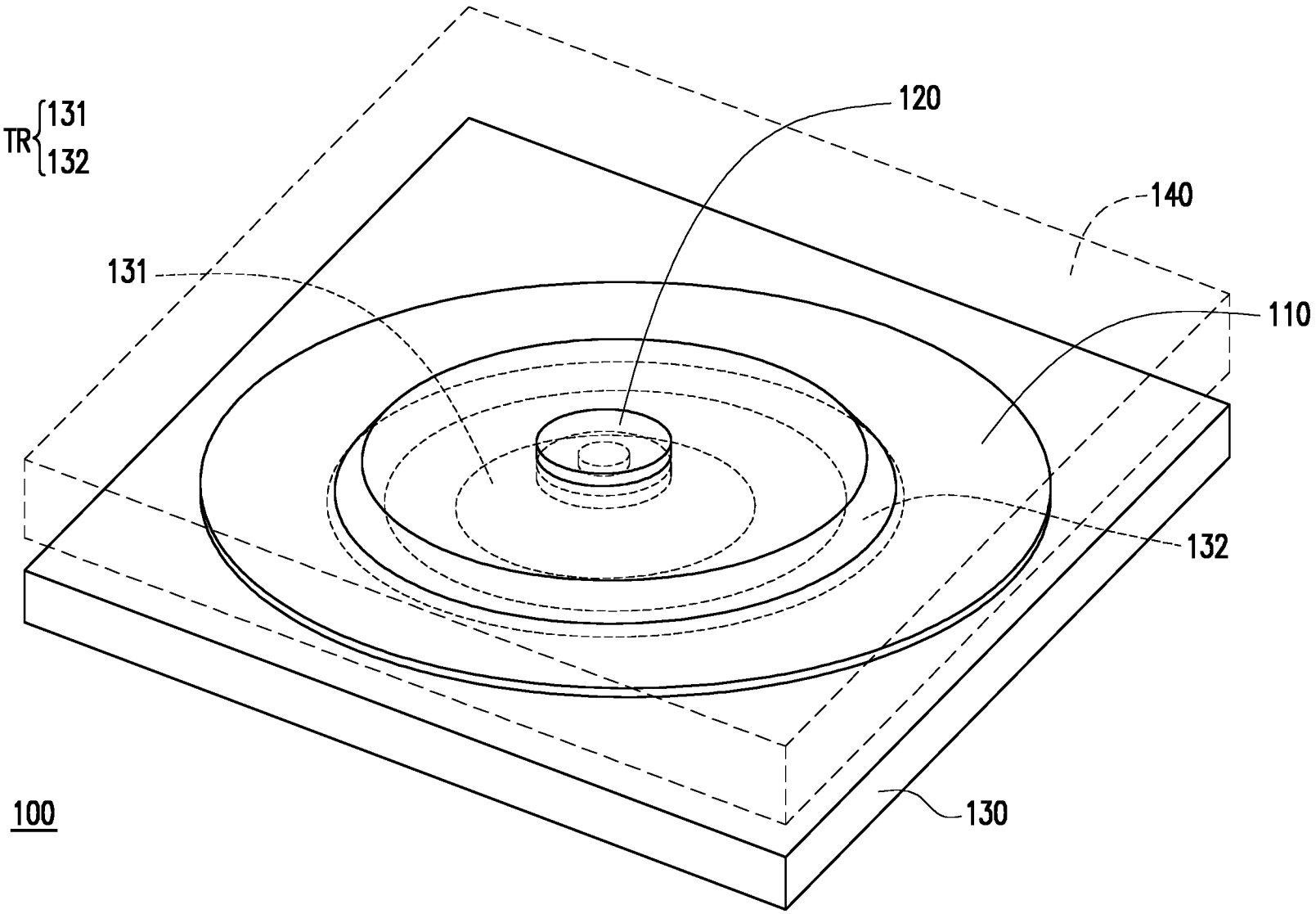
FIG. 1 is a schematic diagram of a button structure according to an embodiment of the invention.
Figure 2:
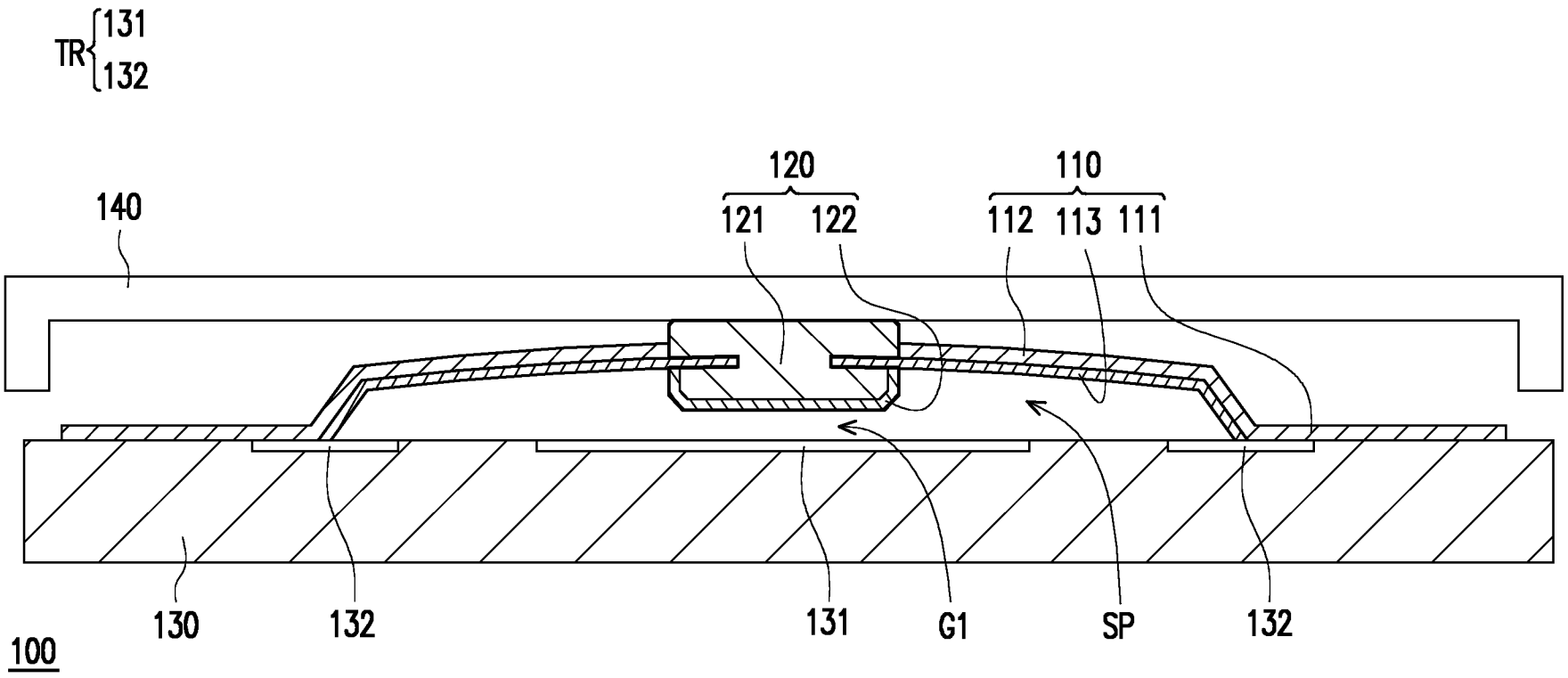
FIG. 2 is a partial cross-sectional view of the button structure of FIG. 1.

FIG. 1 is a schematic diagram of a button structure according to an embodiment of the invention. Some components herein are represented by dashed lines to facilitate identification. FIG. 2 is a partial cross-sectional view of the button structure of FIG. 1. Referring to FIG. 1 and FIG. 2 together, in this embodiment, a button structure 100 includes a circuit board 130, a dome element 110, and a trigger 120. The dome element 110 is disposed on the circuit board 130 and is electrically conductive and elastic. The trigger 120 is disposed at a center of the dome element 110 and is electrically insulative and flexible. The trigger 120 further includes a conductive layer 122 facing the circuit board 130, where the dome element 110 is configured to be pressed to drive the conductive layer 122 of the trigger 120 to abut against a trigger circuit TR of the circuit board 130 to generate a trigger signal, and in this case, elastic force is accumulated due to deformation caused by pressing the dome element 110. Once a user releases the applied force without pressing the dome element 110, the accumulated elastic force may drive the dome element 110 and the trigger 120 thereon to reset.

It should be noted that a keycap 140 is provided as an example in FIG. 2. However, the input device in the present embodiment may be substantially a related device such as a keyboard, a key, a button, a touch pad, or the like that generates a corresponding electronic trigger signal through the pressing action of the user. Furthermore, in the present embodiment, the trigger 120 is made of silicone rubber, and the dome element 110 is made of metal and is hollowed out at the center, so that the trigger 120 may be fitted to the center of the dome element 110 by using an insert molding process. As shown in FIG. 2, a fitting portion 121 of the trigger 120 is fitted to the dome element 110, and the conductive layer 122 is located at the bottom of the fitting portion 121.

Specifically, the dome element 110 has a main body 112 and a surrounding edge 111 surrounding the main body 112, the surrounding edge 111 abutting against the circuit board 130, so that the main body 112 covers and stands above the circuit board 130 to form a space SP. The fitting portion 121 of the trigger 120 fits and passes through the center of the main body 112, the conductive layer 122 is located at a part of the fitting portion 121 of the trigger 120 passing through the space SP, and a gap G1 remains between the trigger 120 and the circuit board 130 when the dome element 110 is not pressed. For example, the dome element 110 herein bonds, by using an adhesive layer (not shown), the surrounding edge 111 and a part that does not belong to the trigger circuit TR on the circuit board 130 together.

In contrast, the trigger circuit TR includes a first circuit 131 and a second circuit 132 that are electrically disconnected from each other. The dome element 110 abuts against and stands on the second circuit 132, that is, the surrounding edge 111 abuts against the second circuit 132, so that the main body 112 covers and stands above the circuit board 130, and the gap G1 remains between the conductive layer 122 of the trigger 120 and the first circuit 131, and when the dome element 110 is not pressed, the gap G1 is maintained between the trigger 120 (and the conductive layer 122) and the first circuit 131. Conversely, when the dome element 110 is pressed, the conductive layer 122 of the trigger 120 may be driven to abut against the first circuit 131, so that the first circuit 131 and the second circuit 132 are in electrical conduction with the dome element 110 through the conductive layer 122.

Referring to FIG. 2 again, in the present embodiment, the dome element 110 further has another conductive layer 113 disposed on an inner wall of the main body 112 and electrically connected between the second circuit 132 and the conductive layer 122. When the dome element 110 is pressed, the first circuit 131 is electrically connected to the second circuit 132 through the conductive layer 122 and the another conductive layer 113 in sequence, and a trigger signal is generated due to electrical conduction of the first circuit 131 and the second circuit 132.

Based on the above, in the foregoing embodiments of the invention, in the button structure of the input device, the dome element is electrically conductive and elastic, and the trigger is disposed at the center of the dome element, is electrically insulative and flexible, and has the conductive layer facing the circuit board. Accordingly, when the dome element is pressed, the trigger signal may be smoothly generated by driving the conductive layer of the trigger to abut against the trigger circuit of the circuit board, and the impact force between the components may be effectively reduced due to the flexibility of the trigger during triggering, thereby reducing noise caused by mutual impact between the components. In addition, elastic force is accumulated due to deformation caused by pressing the dome element.

On the contrary, when the dome element is not pressed, the elastic force accumulated in the dome element may drive the trigger to reset smoothly away from the circuit board. In other words, for the button structure, the trigger may be reset smoothly only by the dome element without the help of other components, so that the button structure is simplified and has a shorter pressing stroke, and a situation that the components cannot be thinned due to stacking may be avoided.

In other words, in comparison to the dome element (that is, a rubber dome element) with a rubber elastic member as the button structure in the prior art, although the mute effect may be achieved, thinning cannot be effectively realized, and the pressing stroke may not be reduced. On the contrary, in comparison to the dome element (that is, a metal dome element) with a metal dome as the pressing structure in the prior art, although the pressing stroke may be effectively reduced, the noise caused by the impact of the components during the pressing may not be avoided. Therefore, according to the invention, the trigger and the dome element are made of different materials, and especially the trigger is fitted to the center of the dome element by using the insert molding process, so that the foregoing situation may be effectively improved, thereby achieving a low pressing stroke and a mute effect.

What is claimed is:

1. A button structure of an input device, comprising: a circuit board; a dome element, disposed on the circuit board and electrically conductive and elastic; and a trigger, disposed at a center of the dome element, electrically insulative and flexible, and having a conductive layer facing the circuit board, wherein the dome element is configured to be pressed to drive the conductive layer of the trigger to abut against a trigger circuit of the circuit board to generate a trigger signal, wherein the trigger is made of silicone rubber, the dome element is made of metal, and the trigger is fitted to a center of the dome element by using an insert molding process.

2. The button structure of the input device according to claim 1, wherein the dome element has a main body and a surrounding edge surrounding the main body, the surrounding edge abuts against the circuit board, so that the main body covers and stands above the circuit board to form a space, the trigger is fitted to and passes through a center of the main body, the conductive layer is located at a part of the trigger passing through the space, and a gap remains between the trigger and the circuit board when the dome is not pressed.

3. The button structure of the input device according to claim 1, wherein the trigger circuit comprises a first circuit and a second circuit electrically disconnected from each other, the dome element abuts against and stands on the second circuit, a gap remains between the trigger and the first circuit when the dome element is not pressed, and the conductive layer of the trigger abuts against the first circuit when the dome element is pressed, so that the first circuit and the second circuit are in electrical conduction with the dome element through the conductive layer.

4. The button structure of the input device according to claim 3, wherein the dome element comprises a main body and a surrounding edge surrounding the main body, the surrounding edge abuts against the second circuit, so that the main body covers and stands above the circuit board, and a gap remains between the conductive layer of the trigger and the first circuit.

5. The button structure of the input device according to claim 4, wherein the dome element further has another conductive layer disposed on an inner wall of the main body and electrically connected between the second circuit and the conductive layer.

6. The button structure of the input device according to claim 3, wherein the dome element further has another conductive layer electrically connected between the second circuit and the conductive layer, and the first circuit is electrically connected to the second circuit sequentially through the conductive layer and the another conductive layer when the dome element is pressed.

* * * * *